US005645139A

United States Patent [19]

Liou

[11] Patent Number: 5,645,139

[45] Date of Patent: Jul. 8, 1997

[54] CIRCULATABLE LADDER

[76] Inventor: David Liou, 40, Tzu Chiang Rd., Chung Ho, Taipei Hsien, Taiwan

[21] Appl. No.: 342,211

[22] Filed: Nov. 18, 1994

[51] Int. Cl.[6] ..... A62B 1/00

[52] U.S. Cl. ..... 182/44; 182/42; 182/236

[58] Field of Search ..... 182/42–7, 44, 182/141, 18, 142, 236

[56] References Cited

U.S. PATENT DOCUMENTS

| | | | |
|---|---|---|---|
| 184,978 | 12/1876 | Neville | 182/238 X |
| 642,392 | 1/1900 | Vaughan | 182/43 |
| 670,050 | 3/1901 | Hull | 182/44 |
| 776,483 | 12/1904 | Andrews | 182/43 |
| 825,524 | 7/1906 | Dodds | 182/44 |
| 892,281 | 6/1908 | Metter | 182/18 |
| 4,570,750 | 2/1986 | Tsai | 182/44 |

FOREIGN PATENT DOCUMENTS

| | | | |
|---|---|---|---|
| 122792 | 2/1919 | United Kingdom | 182/43 |
| 2157254 | 10/1985 | United Kingdom | 182/142 |

*Primary Examiner*—Alvin C. Chin-Shue
*Attorney, Agent, or Firm*—Christie, Parker & Hale, LLP

[57] ABSTRACT

The present invention relates generally to the safety equipment of a circulatable ladder. The device requires no automatic power and can be operated for heavy loading capacity. The device includes a track set, a circulatable chain mounted along the track set, a securing device secured to a building for securing thereon the track set and a decelerator mounted on the securing device for slowing down the circulating speed of the circulatable chain.

18 Claims, 10 Drawing Sheets

CIRCULATABLE LADDER

FIELD OF THE INVENTION

The present invention relates generally to the equipment of a circulatable ladder. The device requires no power and can be operated for high loading capacity.

BACKGROUND OF THE INVENTION

Most conventional safety equipment is for private use and cannot provide a high loading capacity. In addition, the equipment is provisionally installed when needed to the relevant connecting structure and the securing medium might not result in securing the safety of the escaping person. Furthermore, some escaping devices require operating skill which is dangerous for some users, e.g., a child or an older person.

SUMMARY OF THE INVENTION

An object of the present invention is to provide equipment requiring no power and being adaptable to a building of any height.

In accordance with the present invention, the circulatable ladder includes a track set, a circulatable chain mounted along the track set, a securing device adapted to be secured to a building for securing the track set, and a decelerator mounted on the securing device for slowing down a circulating speed of the circulatable chain. The track set includes two endless U-shaped cross-sectional tracks. Each of the two tracks includes a plurality of U-shaped cross-sectional track segments for being adapted to an expansion and/or a deformation thereof.

Preferably, the track set includes an upper and lower arcuate turning portion having a U-shaped cross section slightly larger than that of the other portions of each of the two tracks.

The circulatable chain includes a plurality of parallelly spaced shafts mounted between the two U-shaped cross-sectional tracks, and a plurality of flat plates, each of which has two shaft holes for passing therethrough two end portions of two adjacent shafts.

The circulatable chain further includes a plurality of nuts screwed to the shafts for fastening the flat plates onto the shafts. The middle part of each of the shafts has a diameter larger than the remaining part of each shaft which is provided with a screw thread for screwing thereon one of the nuts.

Each of the shafts includes two ends connecting thereto two contact media located inside the two U-shaped cross-sectional tracks so that a circulation of the chain in these U-shaped cross-sectional tracks is smooth. The two contact media may be a pulley or a bearing.

A plurality of stands are spacedly secured to the circulatable chain. Each of the stands further includes two flat pieces connected to one of the shafts and has a first position at which the flat pieces lie against the circulatable chain and a second position at which the flat pieces are kept perpendicular to the circulatable chain. The two flat pieces are secured to two of the flat plates respectively and are provided with two protrusions for keeping the flat pieces at the second position. Preferably, each stand further comprises a safeguarding medium in order that a person can stand thereon more comfortably and safely. The safeguarding medium may be a net or a board.

In accordance with another aspect of the present invention, the ladder further includes a plurality of striking media spacedly mounted on the circulatable chain, and a bell mounted on the track set for sounding whenever the striking media strikes the bell.

The decelerator includes a first shaft and a reduction gear assembly including two sprockets for the circulatable chain. The reduction gear assembly has an initial gear mounted on the first shaft, a plurality of intermediate shafts spacedly mounted on the securing device, and a final shaft mounted on the securing device. Further, the decelerator comprises at least one wind leaf which is mounted on the final shaft in order to regulate the circulating speed. The wind leaf further includes a sub-leaf attached movably parallel to the wind leaf. A spring is mounted between the sub-leaf and the wind leaf for always urging the sub-leaf in a retracted position in order to assist the wind leaf to regulate the circulating speed.

The present invention may best be understood through the following description with reference to the accompanying drawings, in which:

DETAILED DESCRIPTION OF THE PREFERRED EMBODIMENT

Figure 1:
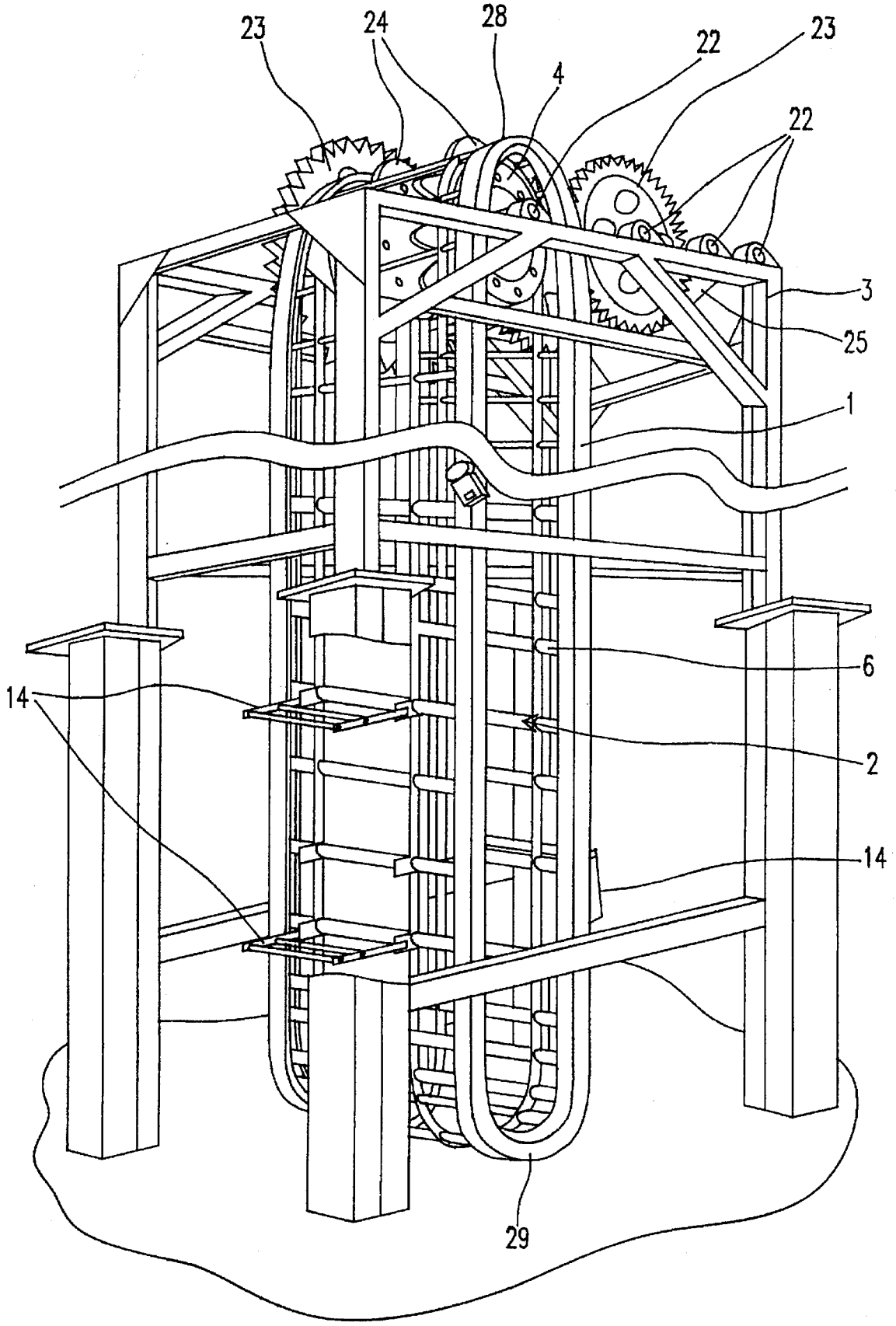
FIG. 1 is a schematic perspective view showing a preferred embodiment of a circulatable ladder according to the present invention.

Referring to FIG. 1, a preferred embodiment of the circulatable ladder includes a track set 1, a circulatable chain 2 mounted along the track set 1, a securing device 3 adapted to be secured to a building for securing thereon the track set 1, and a decelerator 4 mounted on the securing device 3 for slowing down a circulating speed of the circulatable chain 2.

Figure 2:
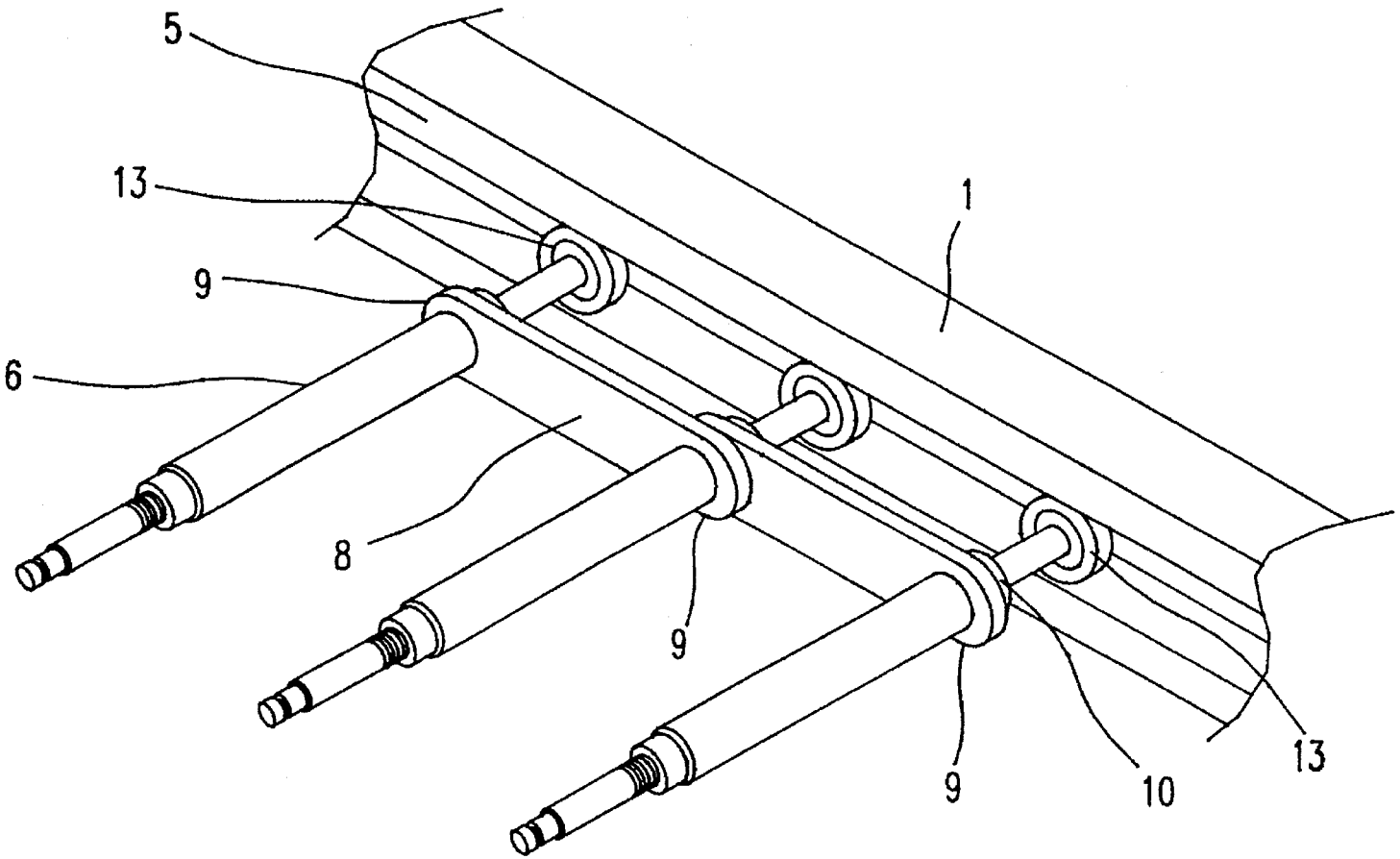
FIG. 2 is a schematic view showing the U-shaped cross-sectional track, the shafts and the flat pieces of a preferred embodiment of a circulatable ladder according to the present invention.

Referring to FIG. 2, the track set 1 includes two, of which only one is shown, generally endless U-shaped cross-sectional tracks 5. Each of the two tracks 5 includes a plurality of U-shaped cross-sectional segments for adjusting the length of the ladder. Further, the cross-sectional area of the upper and the lower turnings 28 and 29 respectively, (see FIG. 1) of the U-shaped cross-sectional track 5 is wider than the remaining part of the U-shaped cross-sectional track 5 so that the circulatable chain 2 can circulate smoothly in the track set 1.

Figure 3:
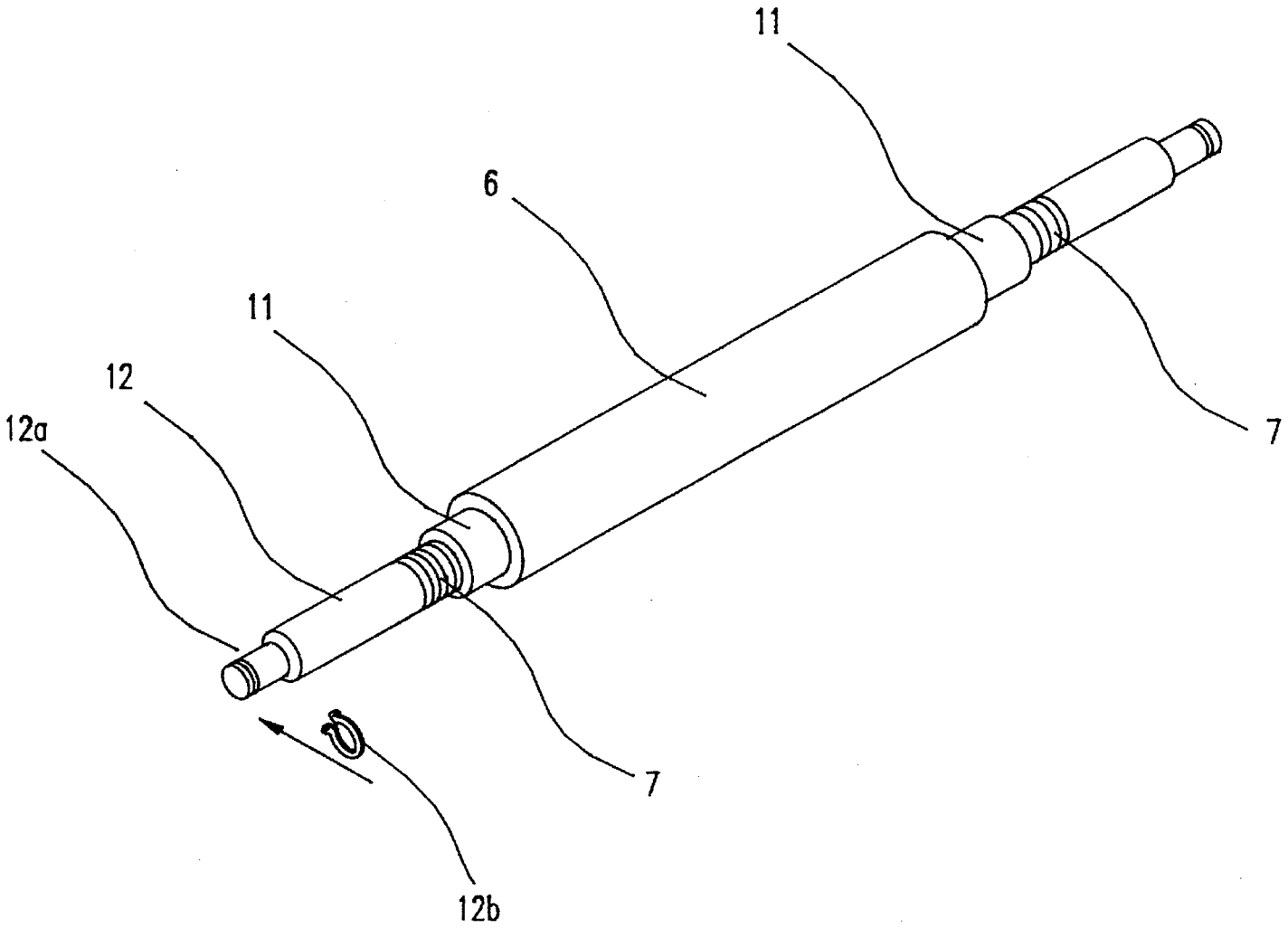
FIG. 3 is a schematic view showing a preferred embodiment of a shaft for a circulatable ladder according to the present invention.
Figure 4:
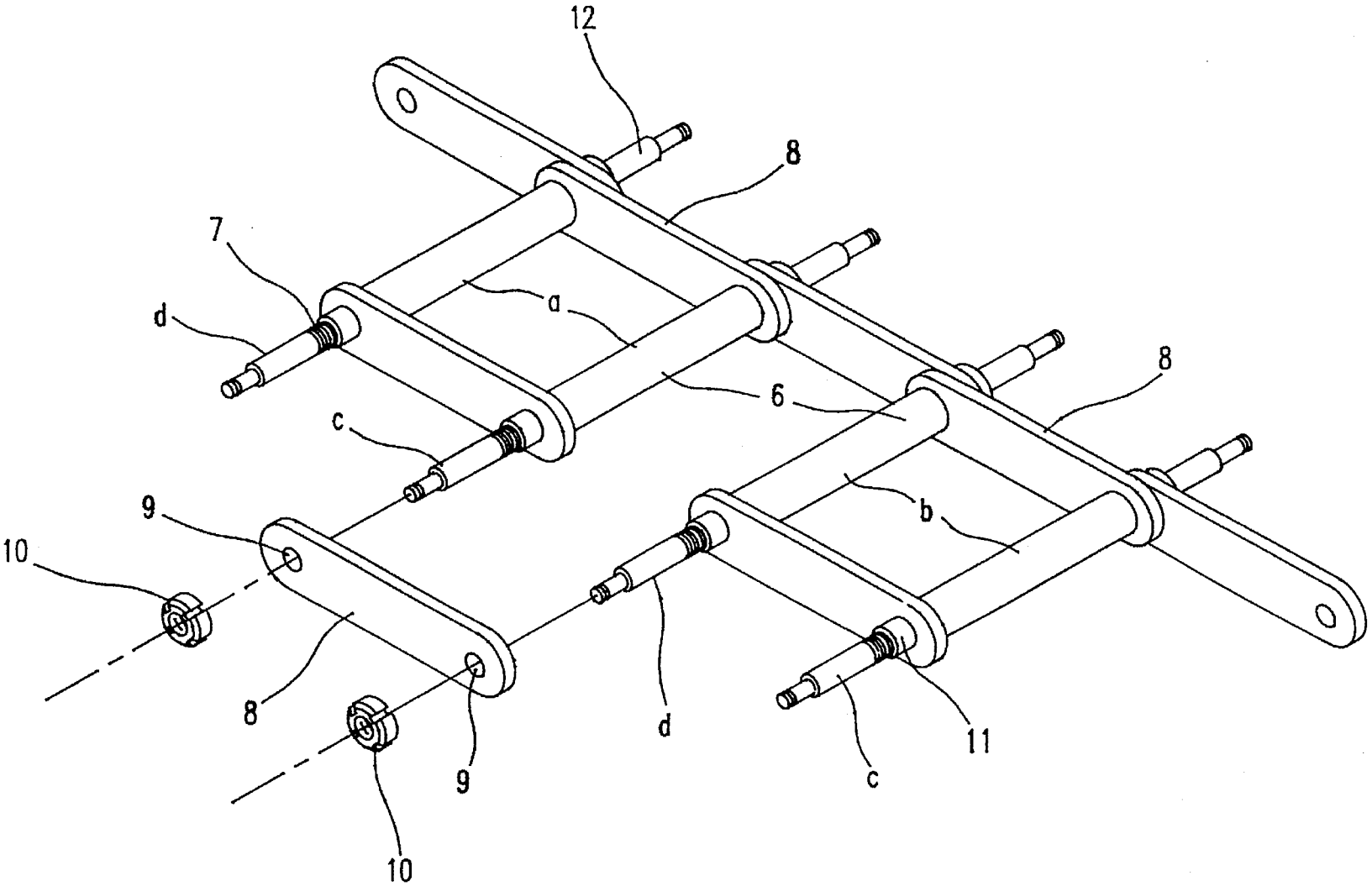
FIG. 4 is a schematic view partly showing a preferred embodiment of the circulatable chain for a circulatable ladder according to the present invention.

Referring to FIGS. 1, 3 and 4, the circulatable chain 2 includes a plurality of shafts 6 having a thread 7 on each of their two end portions, a plurality of flat plates 8 each of which has two shaft holes 9 for respectively passing therethrough two end portions of two adjacent shafts 6, and a plurality of nuts 10 respectively screwed to the screw thread 7 of shafts 6. Further, shafts 6 are parallelly spaced between the two U-shaped cross-sectional tracks 5, and have a length slightly shorter than the width of the U-shaped cross-sectional track 5.

A middle part of each of the shafts 6 has a diameter larger than that of the shaft holes 9 on each of the flat plates 8 so as to prevent the flat plates 8 from moving toward the middle part of shaft 6. Each of the end portions of the shaft 6 has a first part 11, a thread part 7 and an end part 12 having a distal portion 12*a* having a reduced diameter.

Referring to FIG. 4, to assemble a circulatable chain 2, two ends of two shafts 6 of the first group a are inserted through the two shaft holes 9 of a flat plate 8. Two ends of another two shafts 6 of the second group b are inserted through two shaft holes 9 of another flat plate 8. Thereafter, the end of the lower shaft c of the first group a and the upper shaft d of the second group b are inserted through two shaft holes 9 of a third flat plate 8. Thus, we can fasten relevant plates 8 against middle parts of relevant shafts 6 with nuts 10. Consequently, reiterate the previous steps until the lower shaft c of the last group and the upper shaft d of the first group a have been chained together. Then a circulatable chain 2 is established.

Referring to FIGS. 2 and 3, preferably, distal portion 12*a* of each of the shafts 6 to be mounted in the U-shaped cross-sectional track 5 may be provided with a pulley or a bearing 13 retained thereon by a C-retainer 12*b* so that the circulatable chain 2 can circulate in track set 1 smoothly.

Figure 5:
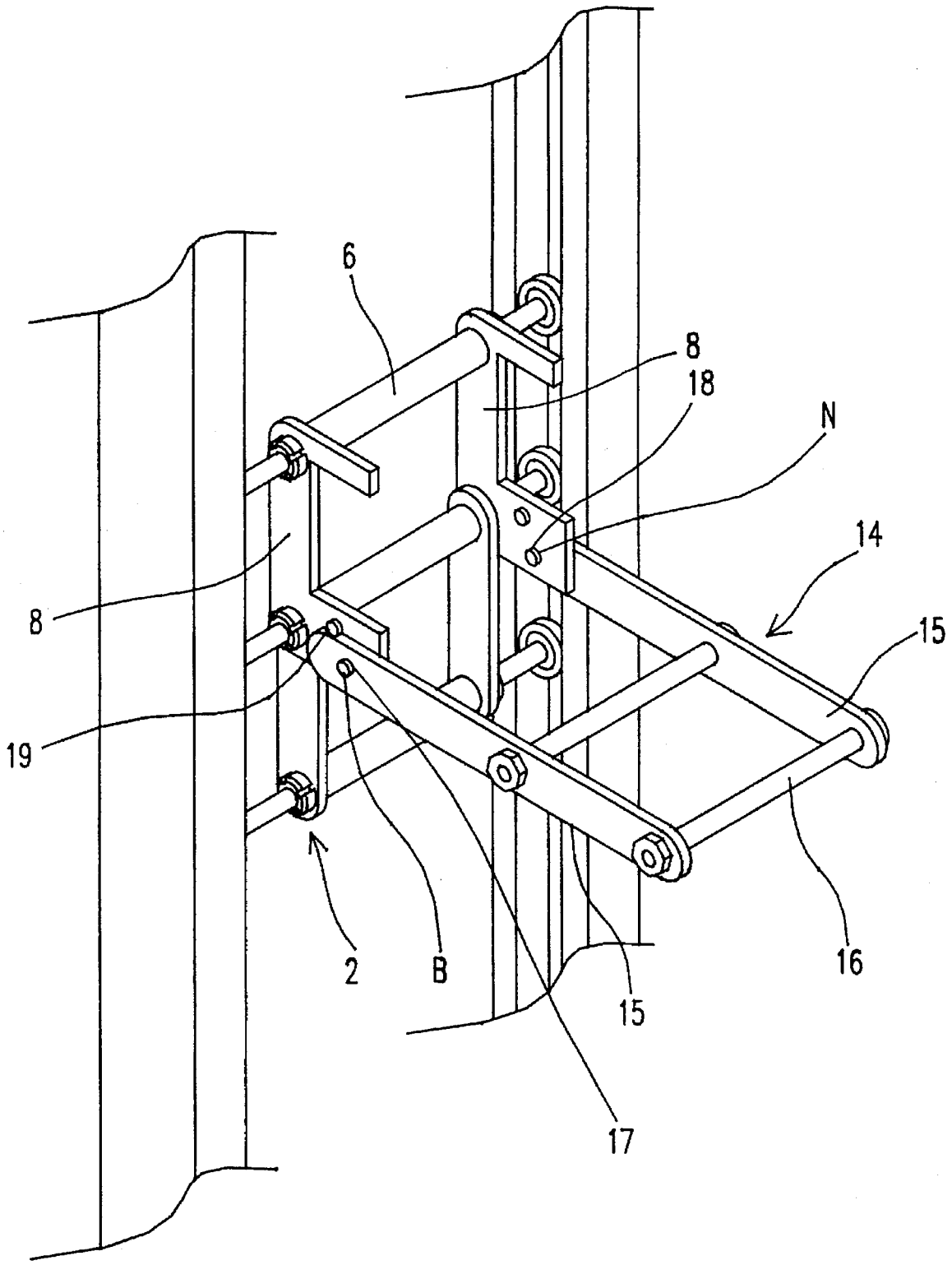
FIG. 5 is a schematic view primarily showing a preferred embodiment of a stand for a circulatable ladder according to the present invention.

Referring to FIG. 5, spaced a certain distance along the shafts 6 of the circulatable chain 2 are stands 14, each of which has at least one traverse shaft 16 mounted between two flat plates 15. On one end of each of the two flat plates 15, there is a hole 17. The two flat plates 8 of the circulatable chain 2 at which each stand is located are L-shaped to have holes 18 and protrusions 19. The holes 18 of the two L-shaped flat plates 8 with the holes 17 of the flat plates 15 mount the stand 14 by applying bolts B and nuts N. The protrusions 19 is to block against and keep the two flat plates 15 of the stand 14 perpendicular to the chain 2 when stand 14 is downwardly dropping through gravity so that the escaping person can stand on the stand 14 easily.

It is noted that even though some parts of the circulatable chain 2 are subjected to a deformation or broken into pieces, the circulatable chain 2 will still be entirely retained in the track set 1 and kept in circulation and thus will positively safeguard escaping persons from falling and/or being hurt.

Preferably, due to the gravity of the person or other load, the present invention can be started without an external power. Further, a net netted around or a board mounted on the stand 14 will add to safeguard the relevant person from dropping.

Figure 6:
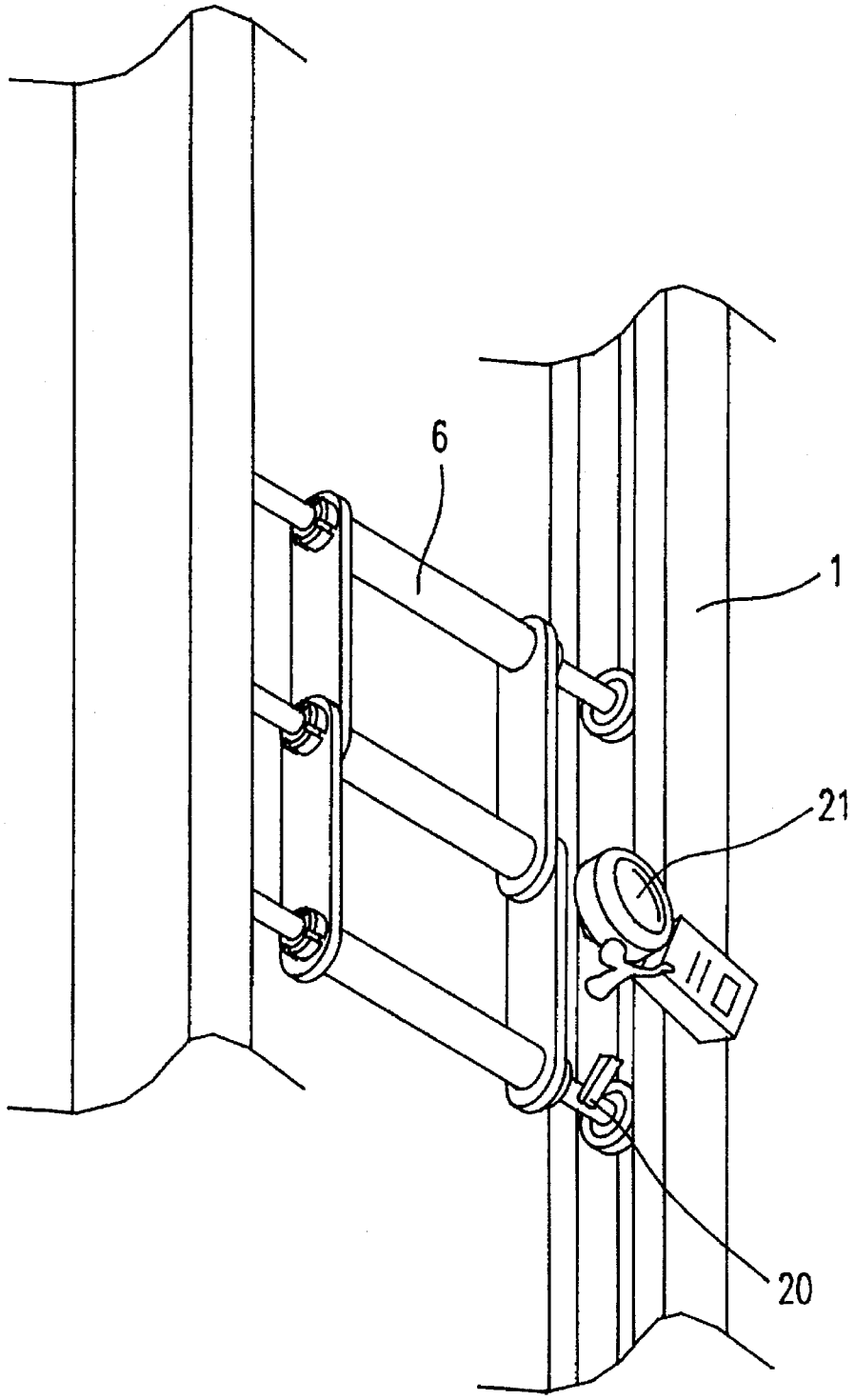
FIG. 6 is a schematic view showing preferred embodiments of the striking media and the bell for a circulatable ladder according to the present invention.

Referring to FIG. 6, spaced a certain distance along the shafts 6 of the circulatable chain 2 are the striking media 20. A bell 21 is mounted on the track set 1 for sounding whenever there is one of the striking media 20 striking the bell 21 for notifying the person a vertical displacement of the circulatable chain 2 has circulated. Further, once the circulatable chain 2 is initiated to circulate, the bell 21 will periodically sound accordingly.

Figure 7A:
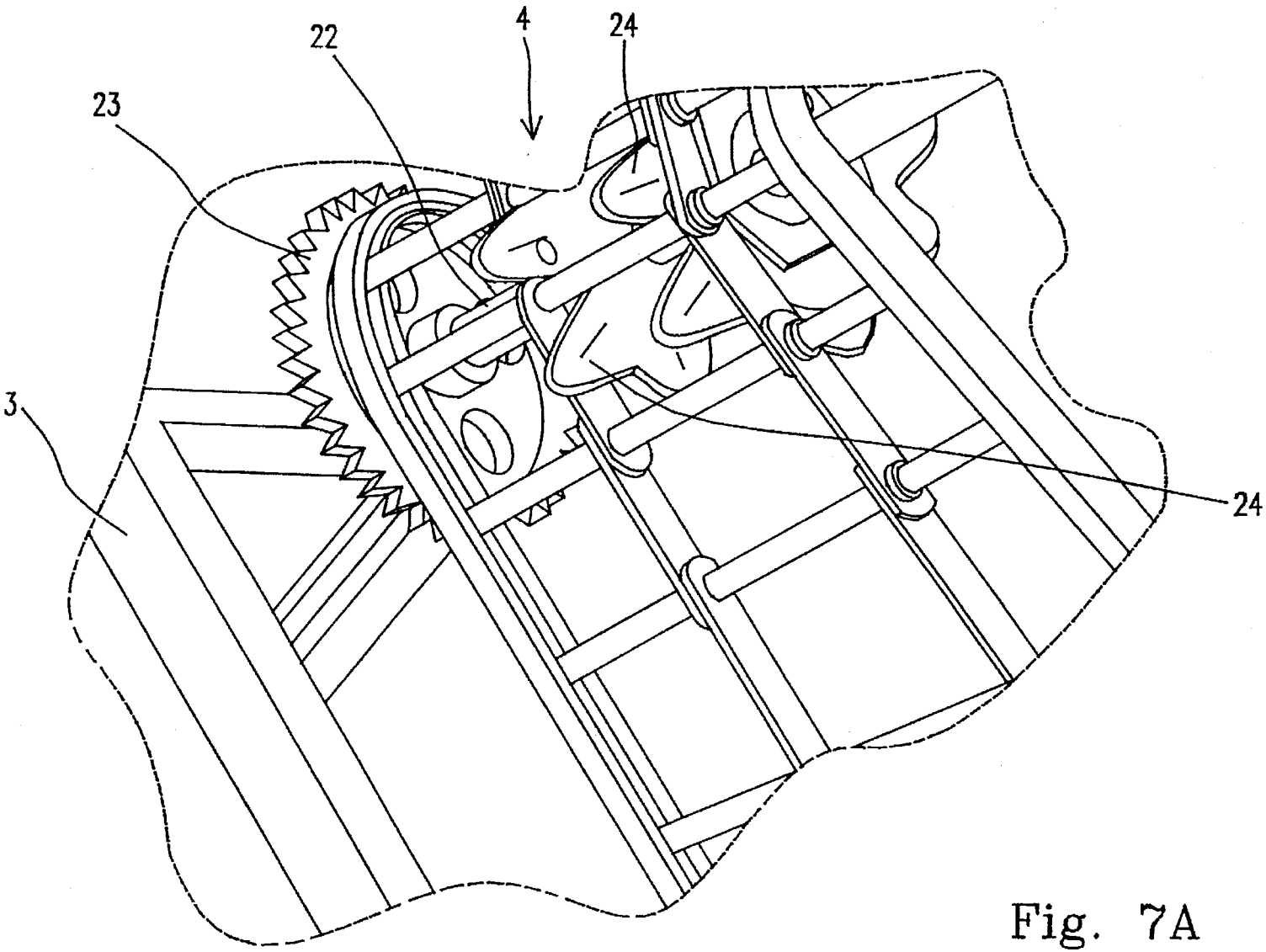
FIGS. 7A and 7B are schematic views showing a preferred embodiment of the decelerator for a circulatable ladder according to the present invention.
Figure 7B:
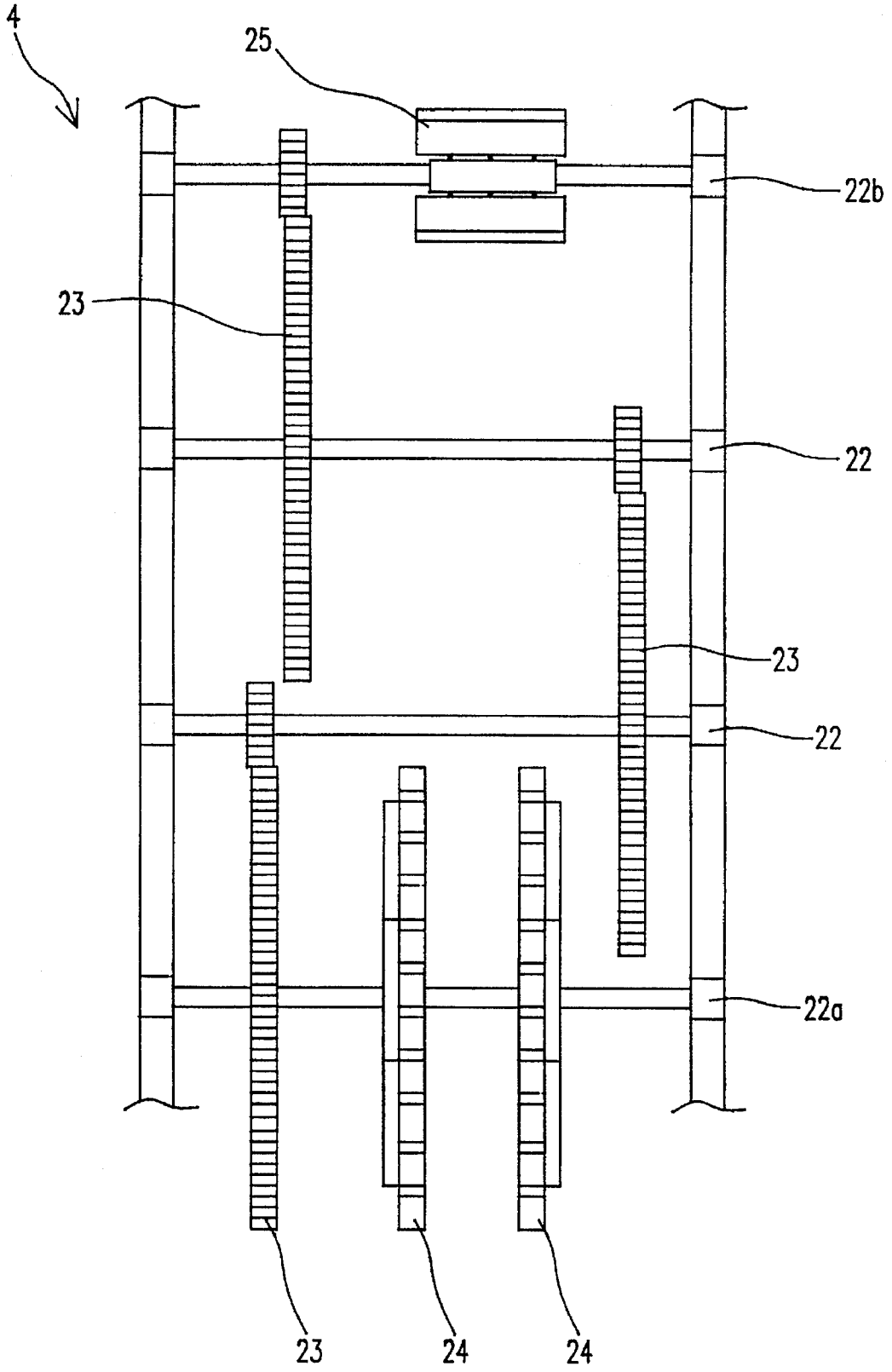

Referring to FIGS. 7A and 7B, the decelerator 4 includes a plurality of shafts 22 secured on the securing device 3, a plurality of transmission gears 23 mounted on the shafts 22 and two sprockets 24. The sprockets 24 are mounted on a first shaft 22*a* and each of the sprocket teeth can be inlaid between every two adjacent shafts 6 of the circulatable chain 2. Consequently, the circulatable chain 2 might circulate smoothly on these two sprockets 24 and along the U-shaped cross-sectional track 5.

Figure 8:
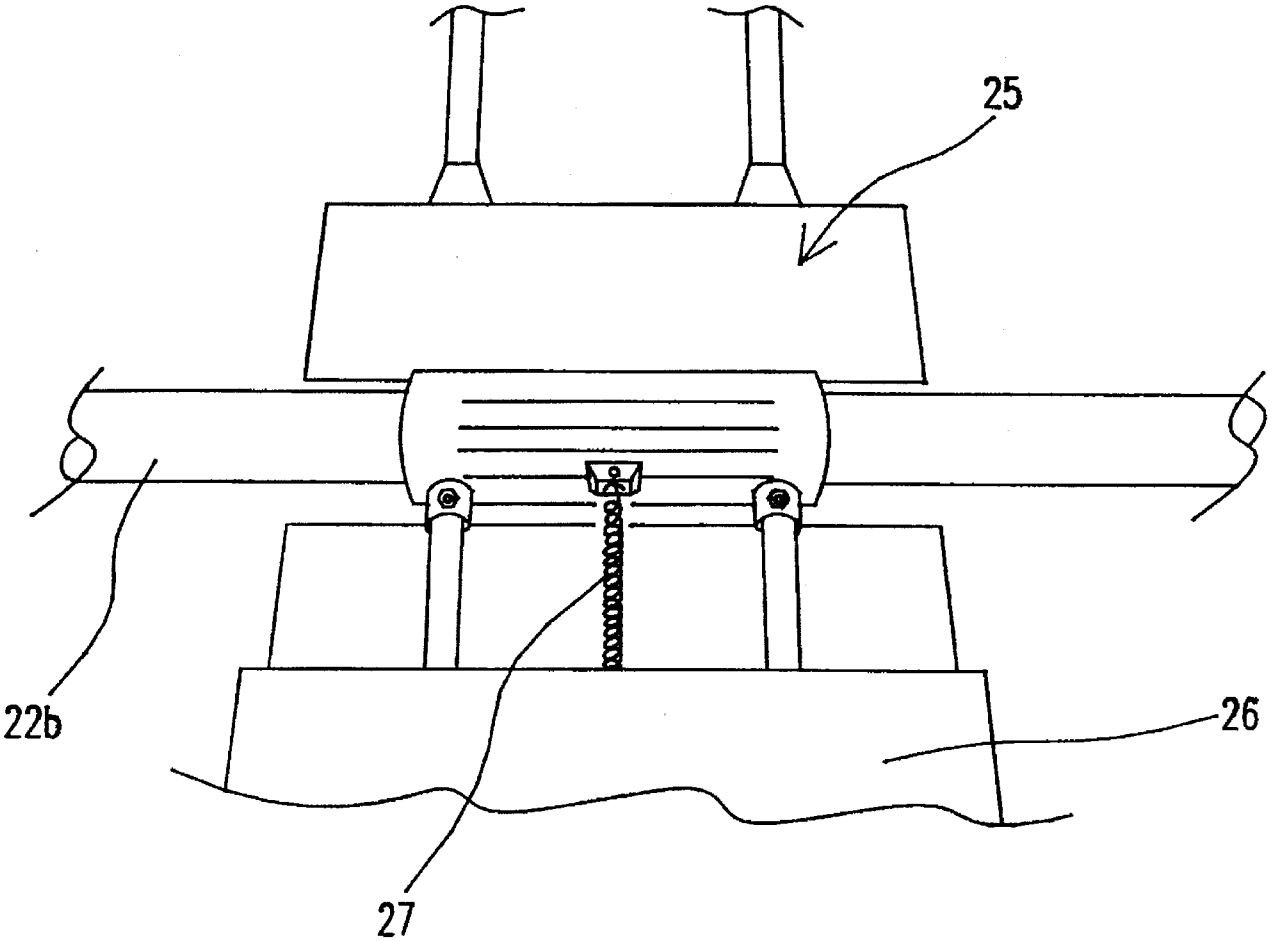
FIG. 8 is a schematic view showing a preferred embodiment of the wind leaf for a circulatable ladder according the present invention.

Referring to FIG. 8, to reduce the circulating speed of the circulatable chain 2 due to a heavy loading, the decelerator further includes a reduction gear assembly. The reduction gear assembly further includes at least one wind leaf 25 which is mounted on a final gear shaft 22*b*. Preferably, the wind leaf 25 further includes a sub-leaf 26 overlappingly attached and movingly parallel to the wind leaf 25 by a spring 27 mounted between the sub-leaf 26 and the wind leaf 25 for always urging the sub-leaf 26 in a retracted position and responding to the centrifugal force resulting from the loading of the stands 14 and/or the wind resistance. As shown in FIG. 8, the sub-leaf 26 slides overlappingly upon wind leaf 25 as the result of air drag on the surface of the sub-leaf. This drag is induced by the air passing through the surface of the sub-leaf due to the relative motion occurring between the sub-leaf and the air generated by the wind leaf during rotation of the ladder. The drag on the sub-leaf pulls the sub-leaf to its extended position, increasing the wind resistance area of the wind leaf 25. Both of the wind leaf 25 and the sub-leaf 26 will aid in regulating the circulating speed of the circulatable chain 2.

Figure 9:
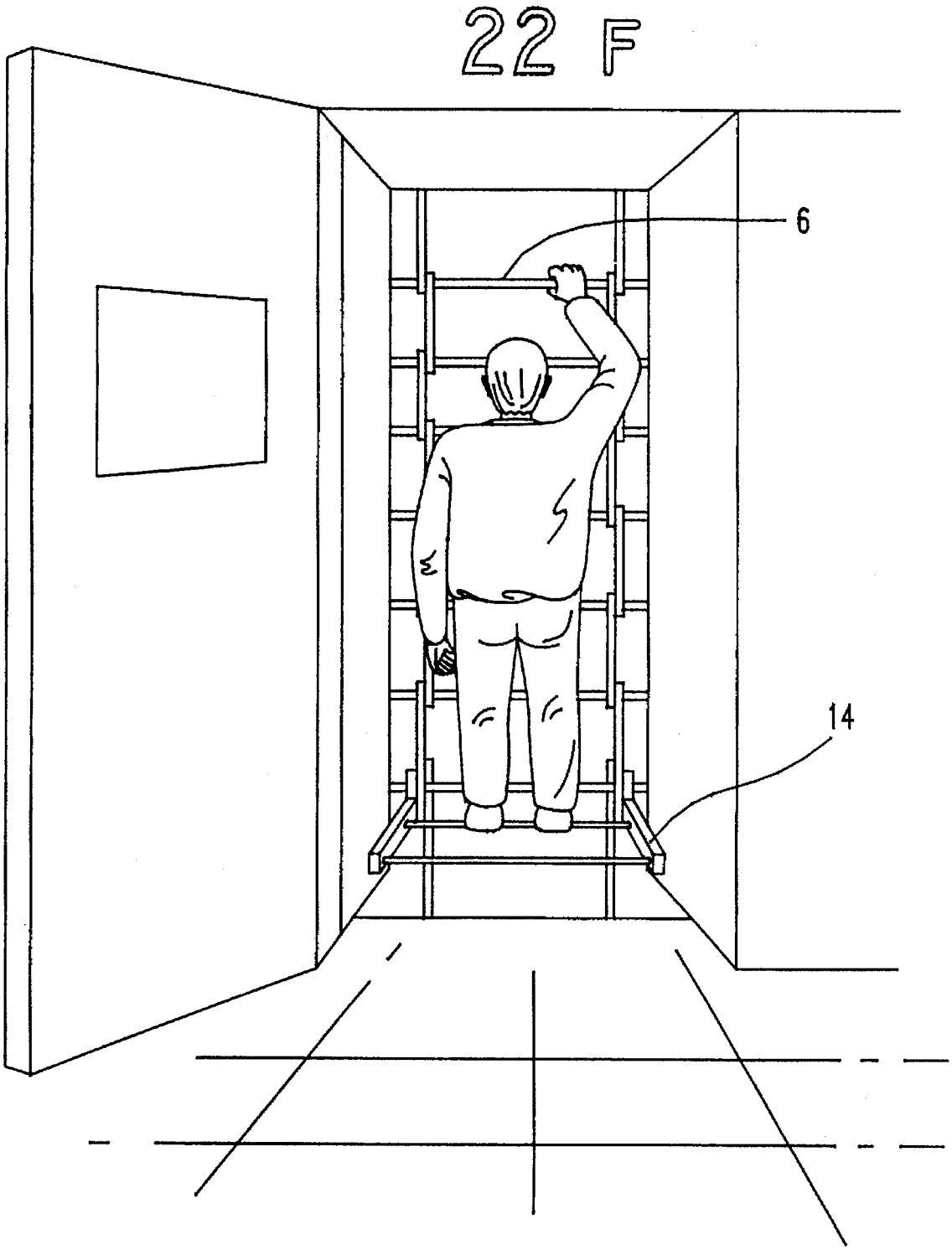
FIG. 9 is a schematic view showing a preferred embodiment of a circulatable ladder according to the present invention.

In accordance with the configuration of the present invention, the circulatable ladder can be used for a high building. The building can be provided with the present circulatable ladder after it is built. Alternatively, the present ladder can be built-in in the building. FIG. 9 is a schematic view showing how a person holds a shaft 6 of the circulatable chain 2 and stands on the stand 14 of a circulatable ladder according to the present invention.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What I claim is:

1. A circulatable ladder comprising:

a track set;

a circulatable chain mounted along said track set;

a securing device adapted to be secured to a building for securing thereon said track set; and a decelerator mounted on said securing device for slowing down a circulating speed of said circulatable chain, the decelerator comprising at least one wind resistor;

said wind resistor further comprising at least one wind leaf having a sub-leaf overlappingly attached and movably parallel to said wind leaf, and a spring mounted between said sub-leaf and said wind leaf for urging said sub-leaf to a retracted position.

2. A ladder according to claim 1, wherein said track set includes two tracks each of which has a U-shaped cross-section.

3. A ladder according to claim 2, wherein said each track set includes an upper and a lower arcuate turning portion having a U-shaped cross-section slightly larger than that of other portions of said each track.

4. A ladder according to claim 1, wherein said track set includes two tracks each of which is endless.

5. A ladder according to claim 1, wherein said track set includes two tracks each of which includes a plurality of U-shaped cross-sectional track segments for being adapted to an expansion and/or a deformation thereof.

6. A ladder according to claim 1, wherein said track set has two U-shaped cross-sectional tracks and said circulatable chain includes a plurality of shafts parallelly spaced and mounted between said two U-shaped cross-sectional tracks, and a plurality of flat plates each having two shaft holes for receiving end portions of two adjacent shafts.

7. A ladder according to claim 6 further comprising a plurality of nuts for fastening said flat plates onto said shafts.

8. A ladder according to claim 7, wherein a middle part of each of said shafts has a diameter larger than that of the remaining part of said each shaft provided with a screw thread for screwing thereon one of said nuts.

9. A ladder according to claim 6, wherein each of said shafts includes two ends, each end being connected to contact media located inside said U-shaped cross-sectional tracks for smooth circulation of said chain in said tracks.

10. A ladder according to claim 9, wherein said contact media are pulleys.

11. A ladder according to claim 9, wherein said contact media are bearings.

12. A ladder according to claim 6 further comprising a plurality of stands spaced along and secured to said circulatable chain.

13. A ladder according to claim 12, wherein each of said stands includes two flat pieces connected to one of said shafts and having a first position at which said flat pieces lie against said circulatable chain and a second position at which said flat pieces are kept perpendicular to said circulatable chain, and a horizontal rod connected between said two flat pieces.

14. A ladder according to claim 13, wherein each said flat piece is secured to a flat plate and is provided with a protrusion for keeping said stand at least second position.

15. A ladder according to claim 13, wherein said each stand further comprises a safeguarding medium in order that a person can stand thereon more comfortably and safely.

16. A latter according to claim 15, wherein said safeguarding medium is a net or a board.

17. A ladder according to claim 1, further comprising:

a plurality of striking media spacedly mounted on said circulatable chain; and a bell mounted on said track set for sounding whenever there is one of said striking media striking said bell.

18. A ladder according to claim 1, wherein said decelerator further includes:

a first shaft having two sprockets for mounting said circulatable chain; and a reduction gear assembly having an initial gear mounted on said first shaft a plurality of intermediate shafts spacedly mounted on said securing device and a final shaft mounted on said securing device.

* * * * *